US010976063B2

(12) United States Patent
Zhou et al.

(10) Patent No.: US 10,976,063 B2
(45) Date of Patent: Apr. 13, 2021

(54) VIBRATION REDUCING GROMMET

(71) Applicant: Carrier Corporation, Palm Beach Gardens, FL (US)

(72) Inventors: Wei Zhou, Avon, IN (US); Asad M. Sardar, Avon, IN (US); Jun Pyo Lee, Zionsville, IN (US); Sherri R. Wilkerson, Indianapolis, IN (US); Dennis J. Blessing, Bargersville, IN (US); Brooke Greenwood, Brownsburg, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/776,728

(22) Filed: Jan. 30, 2020

(65) Prior Publication Data

US 2020/0263883 A1 Aug. 20, 2020

Related U.S. Application Data

(60) Provisional application No. 62/807,475, filed on Feb. 19, 2019.

(51) Int. Cl.
*F24F 1/40* (2011.01)

(52) U.S. Cl.
CPC ..... *F24F 1/40* (2013.01)

(58) Field of Classification Search
CPC ..... F24F 1/40; F24F 1/12
USPC ..... 62/259.1
See application file for complete search history.

(56) References Cited

U.S. PATENT DOCUMENTS

| | | | |
|---|---|---|---|
| 4,306,708 | A | 12/1981 | Gassaway et al. |
| 4,984,971 | A | 1/1991 | Bergeron |
| 6,029,942 | A | 2/2000 | Daddis, Jr. et al. |
| 6,059,503 | A | 5/2000 | Johnson |
| 6,354,558 | B1 | 3/2002 | Li |
| 6,543,741 | B1 | 4/2003 | Li et al. |
| 7,163,200 | B2 | 1/2007 | Dickson et al. |
| 9,010,716 | B2 | 4/2015 | Kobori |
| 9,309,949 | B2 | 4/2016 | Kaneko et al. |
| 2009/0229290 | A1 | 9/2009 | Kim et al. |
| 2017/0254582 | A1 | 9/2017 | Lesko et al. |

FOREIGN PATENT DOCUMENTS

| | | | | |
|---|---|---|---|---|
| CN | 100414138 | C | 8/2008 | |
| CN | 104948659 | | 9/2015 | |
| CN | 205225615 | U | 5/2016 | |
| CN | 207864525 | | 9/2018 | |
| EP | 3235943 | | 10/2017 | |
| EP | 3235943 | A1 * | 10/2017 | ..... D06F 58/20 |
| JP | 2017044282 | A | 3/2017 | |
| WO | 10137585 | | 2/2010 | |

(Continued)

*Primary Examiner* — Steve S Tanenbaum
(74) *Attorney, Agent, or Firm* — Carlson, Gaskey & Olds, P.C.

(57) ABSTRACT

A grommet assembly includes a bolt assembly that has a head portion. A grommet includes a tapering bolt opening for accepting the bolt assembly. A projecting portion extends from a body portion and has an overhang adjacent a distal end. The bolt opening at least partially defines a radial gap between the grommet and the bolt assembly. The head portion of the bolt assembly is spaced from the distal end of the projecting portion by an axial gap.

19 Claims, 2 Drawing Sheets

(56) References Cited

FOREIGN PATENT DOCUMENTS

| | | | | |
|---|---|---|---|---|
| WO | 18089138 | | 5/2018 | |
| WO | WO-2018089138 | A1 * | 5/2018 | ..... F16B 5/0258 |
| WO | 18105508 | | 6/2018 | |

* cited by examiner

VIBRATION REDUCING GROMMET

CROSS-REFERENCE TO RELATED APPLICATIONS

This application claims priority to U.S. Provisional Application No. 62/807,475, which was filed on Feb. 19, 2019 and is incorporated herein by reference.

BACKGROUND

This disclosure relates to a grommet or isolator for a machine, such as a motor or a compressor, to dampen vibrations when the machine is in operation that provides vibration isolation and reduces structure-borne noise and, the grommets also prevent excessive deflection of displacement of the compressor and attached refrigerant tubing sub-system (i.e., to prevent any leaks or cracks) during shipping and transit.

More specifically, the disclosure relates to an isolator for the compressor of an outdoor HVAC unit that can be used to isolate the compressor from other components of an outdoor HVAC unit when the unit is in operation. Many machines, particularly those that are capable of generating vibrations, are mounted to a housing with rubber pads or feet. Operating an outdoor HVAC unit, such as an air conditioning unit or a heat pump, can result in significant noise which is at least partially the result of vibrations generated by components of the outdoor HVAC unit, such as the compressor and cabinetry panels. Therefore, there is a need to reduce transmitted vibrations produced during operation of the outdoor HVAC unit in order to reduce noise and prevent damage to other components in the outdoor HVAC unit as a result of transferred vibrations.

SUMMARY

In one exemplary embodiment, a grommet assembly includes a bolt assembly that has a head portion. A grommet includes a tapering bolt opening for accepting the bolt assembly. A projecting portion extends from a body portion and has an overhang adjacent a distal end. The bolt opening at least partially defines a radial gap between the grommet and the bolt assembly. The head portion of the bolt assembly is spaced from the distal end of the projecting portion by an axial gap.

In a further embodiment of any of the above, a plurality of ribs extend radially inward from an inner surface of the bolt opening toward the bolt assembly.

In a further embodiment of any of the above, a radially inner surface of the ribs are spaced from the bolt assembly.

In a further embodiment of any of the above, the grommet includes a support portion that extends from the body portion and has a support portion base contact surface. The overhang includes an overhang base portion contact surface.

In a further embodiment of any of the above, the support portion base contact surface and the overhang base portion contact surface face opposite axial directions.

In a further embodiment of any of the above, the head portion includes a cap portion. The cap portion is spaced from the distal end of the projecting portion by the axial gap.

In a further embodiment of any of the above, the bolt assembly includes a bolt at least partially surrounded by a sleeve.

In a further embodiment of any of the above, the radial gap extends more than 50% of an axial length of the sleeve.

In a further embodiment of any of the above, the axial length of the sleeve is greater than an axial length of grommet.

In a further embodiment of any of the above, a plurality of ribs extend radially inward from an inner surface of the bolt opening toward the bolt assembly. The head portion includes a cap portion and the cap portion is spaced from the distal end of the projecting portion by the axial gap.

In one another exemplary embodiment, an outdoor HVAC unit includes a housing that has a base pan. A compressor has a base and a grommet assembly connects the base pan to the compressor base. The grommet assembly includes a bolt assembly that has a head portion. A grommet has a tapering bolt opening for accepting the bolt assembly. A projecting portion extends from a body portion and has an overhang adjacent a distal end for engaging the compressor base. The bolt opening at least partially defines a radial gap between the grommet and the bolt assembly. The head portion of the bolt assembly is spaced from the distal end of the projecting portion by an axial gap.

In a further embodiment of any of the above, the grommet assembly further comprises a plurality of ribs that extend radially inward from an inner surface of the bolt opening toward the bolt assembly.

In a further embodiment of any of the above, a radially inner surface of the ribs are spaced from the bolt assembly.

In a further embodiment of any of the above, the grommet includes a support portion that extends from the body portion and has a support portion contact surface that engages a first side of the compressor base. The overhang includes an overhang contact surface that engages a second opposite side of the compressor base.

In a further embodiment of any of the above, the projecting portion extends through an opening in the compressor base.

In a further embodiment of any of the above, the head portion includes a cap portion. The cap portion is spaced from the distal end of the projecting portion by the axial gap.

In a further embodiment of any of the above, the bolt assembly includes a bolt at least partially surrounded by a sleeve.

In a further embodiment of any of the above, the radial gap extends more than 50% of an axial length of the sleeve.

In a further embodiment of any of the above, the axial length of the sleeve is greater than an axial length of grommet.

In a further embodiment of any of the above, the bolt assembly engages the base pan.

DETAILED DESCRIPTION

Figure 1:
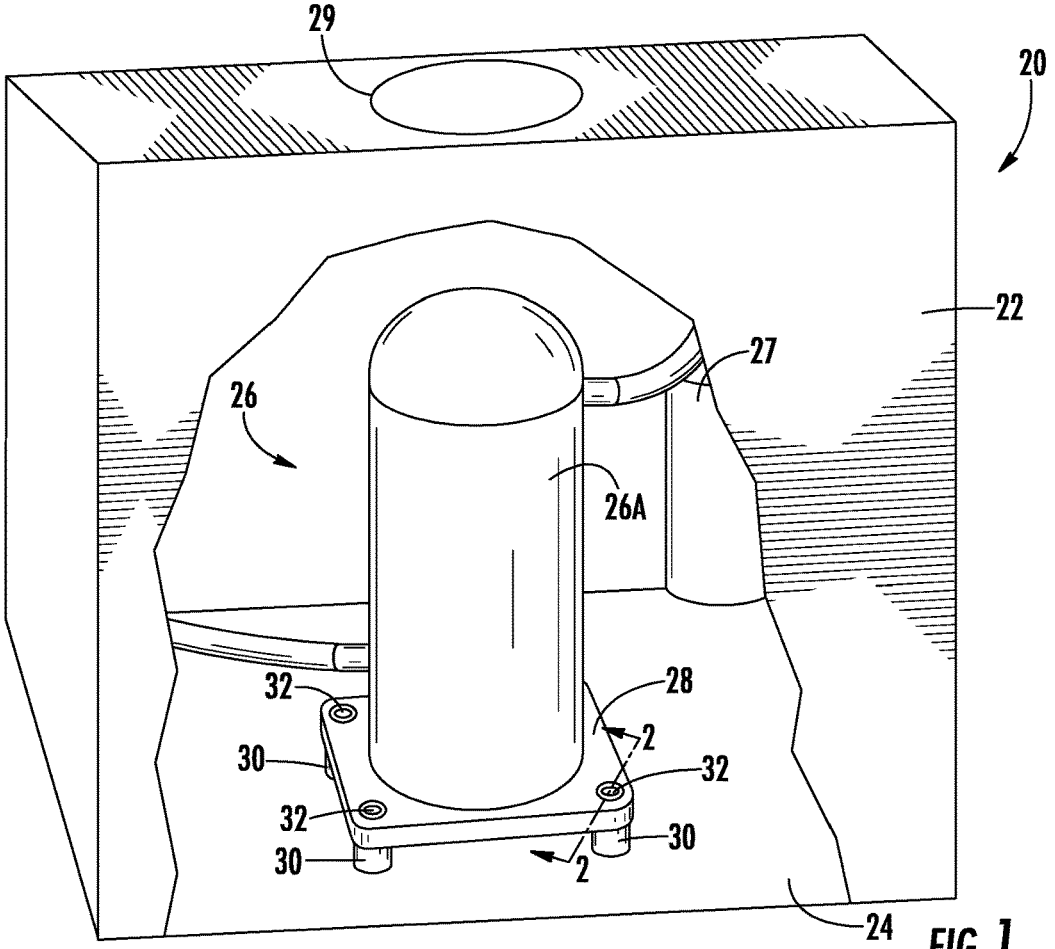
FIG. 1 illustrates an example outdoor HVAC unit.

FIG. 1 illustrates an example outdoor HVAC unit 20, such as an air conditioner or heat pump. The outdoor HVAC unit 20 includes a housing 22 having a base pan 24, a compressor 26, and attached refrigerant tubing (suction and discharge) located within the housing 22. The outdoor HVAC unit 20 could also include other components, such as an accumulator 27, a blower fan 29, and a heat exchanger (not shown).

In the illustrated example, the compressor 26 includes a compressor housing 26A enclosing a compressor motor and a compressor base 28 fixed to a base portion of the compressor housing 26A. The compressor base 28 includes attachment points at the corners for securing the compressor 26 to the base pan 24 of the housing 22. Grommets 30, such as rubber grommets, are attached to the attachment points on the compressor base 28. The grommets 30 are generally secured to the base pan 24 with a bolt 32 extending through each of the grommets 30, and are attached to the base pan 24 with a threaded fastener portion 34 (see FIG. 2). In the illustrated example, the threaded fastener portion 34 is a tapped extrusion. However, the threaded fastener portion 34 could be separately formed and connected with the base pan 24.

During operation of the compressor 26 within the outdoor HVAC unit 20, the compressor 26 generates vibrations that can be transferred to the surrounding structure of the outdoor HVAC unit 20. The grommets 30 seek to reduce the vibrations transferred from the compressor 26 to the surrounding structure by dampening the vibrations. The dampening of vibrations can also reduce the noise generated during operation of the outdoor HVAC unit 20. Although FIG. 1 illustrates an example configuration for supporting the compressor 26 with grommets 30 on the compressor base 28, other grommet 30 configurations could be used for supporting the compressor base 28 relative to the housing 22. Additionally, this disclosure applies to dampening vibrations from other vibration generating components, such as motors.

Figure 2:
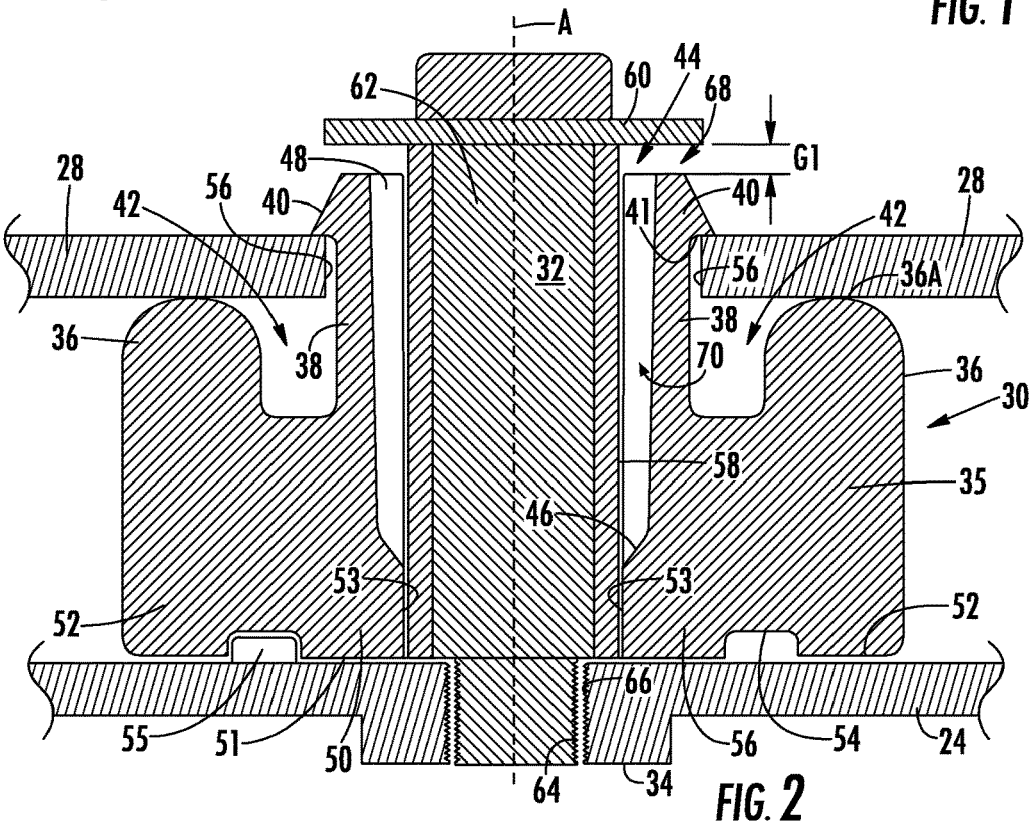
FIG. 2 illustrates a sectional view taken along line 2-2 of FIG. 1.

FIG. 2 is a sectional view along line 2-2 of FIG. 1. In the illustrated example, the grommets 30 form a connection between the compressor base 28 of the compressor 26 and the base pan 24 of the housing 22. In this disclosure, radial or radially and axial or axially is in relation to an axis A extending longitudinally through a center of the bolt 32.

Figure 4:
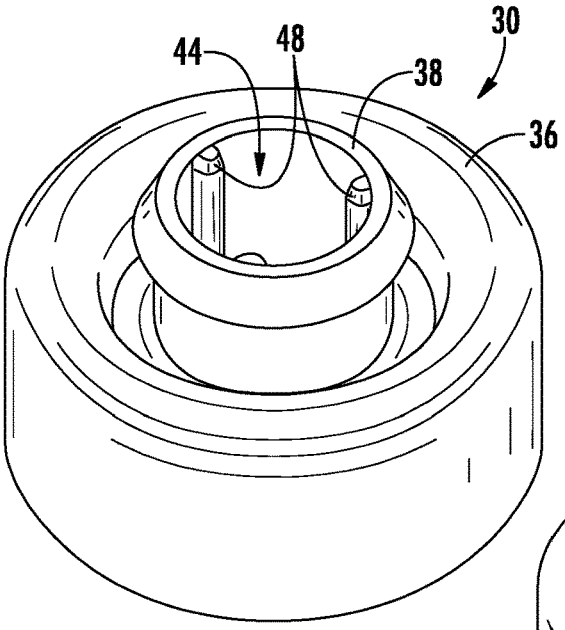
FIG. 4 illustrates a top perspective view of the grommet.
Figure 5:
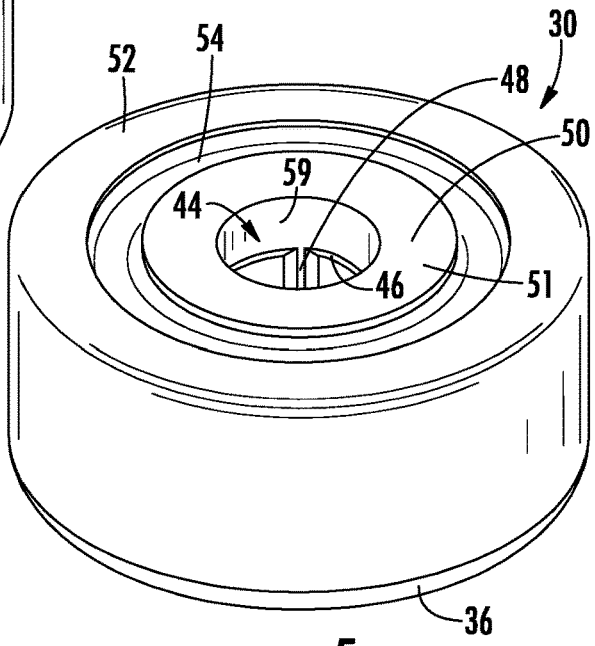
FIG. 5 illustrates a bottom perspective view of the grommet.

As shown in FIG. 2, the compressor base 28 is supported by a support portion 36 on the grommet 30. The support portion 36 extends from a first axial end of a body portion 35 of the grommet 30. In the illustrated example, the support portion 36 includes a contact surface 36A in abutting contact with a lower surface of the compressor base 28. As shown in FIGS. 2 and 4, the support portion 36 is located adjacent to a radially outer portion of the grommet 30 and forms a continuous ring with the contact surface 36A forming a circular contact patch on the compressor base 28.

The grommet 30 also includes a projecting portion 38 that extends from the first axial end of the body portion 35 of the grommet 30. In the illustrated example, the projecting portion 38 extends through a grommet opening 56, or attachment point, in the compressor base 28 to at least partially secure the grommet 30 to the compressor base 28. The projecting portion 38 includes an overhang 40 adjacent to a distal end of the projecting portion 38 with a contact surface 41 that engages an opposite side of the compressor base 28 from the contact surface 36A on the support portion 36. As shown in FIGS. 2 and 4, the projecting portion 38 is located radially inward of the support portion 36 and separated from the support portion 36 by a trough 42. The projecting portion 38 also forms a continuous ring.

The grommet 30 includes a bolt opening 44 that extends from the first axial end to a second axial end of the grommet 30. The bolt opening 44 is at least partially defined by the projecting portion 38 at the first axial end, the body portion 35 along a mid-portion, and a radially inner base portion 50 at the second axial end. The radially inner base portion 50 includes a first contact surface 51 that engages the base pan 24 and second contact surface 53 that engages a sleeve 58. The radially inner base portion 50 also at least partially defines a ledge 46 in the bolt opening 44. In the illustrated example, the ledge 46 is located closer to the second axial end than the trough 42 such that the trough 42 does not overlap axially with the ledge 46.

The second axial end of the grommet 30 also includes a radially outer base portion 52 that is radially aligned with the support portion 36 and axially spaced from the trough 42. The radially inner base portion 50 and the radially outer base portion 52 are spaced from each other by a base trough 54. The base trough 54 is at least partially radially aligned with the trough 42 and can interact with a locating feature 55, such as a tab or circular ring, on the base pan 24 of the housing to locate the compressor 26 relative to the housing 22. The locating feature 55 and the base trough 54 can also contribute to aligning the bolt 32 with a bolt opening 66 in the base pan 24.

As shown in FIG. 2, the bolt 32 includes a smooth shaft portion 62. In the illustrated example, the smooth shaft portion 62 is in engagement with the sleeve 58. A cap portion 60 at a proximal end of the bolt 32 and a threaded portion 64 at a distal end spaced from the smooth shaft portion 62. In the illustrated example, the sleeve 58 and the smooth shaft portion 62 have equal axial lengths that are both greater in axial length than the grommet 30. The threaded portion 64 of the bolt 32 extends through the bolt opening 66 in the base pan 24. Although the sleeve 58 is shown as being separate from the bolt 32, the sleeve 58 could be integrated into the bolt 32 or the sleeve 58 could be eliminated in place of the smooth shaft portion 62.

The cap portion 60 could be integral with the bolt 32 or it could be a separate component, such as a washer, that is held in place relative to the bolt 32 by the sleeve 58. In the illustrated example, the cap portion 60 includes an axial length that is less than a radial thickness of a ring of the cap portion 60. The cap portion 60 and the distal end of the projecting portion 38 define a gap 68 having a distance G1. By spacing the cap portion 60 from the distal end of the projecting portion 38, the transfer of vibrations from the compressor 26 to the base pan 24 is reduced. In the illustrated example, the gap 68 is between approximately 1.0 millimeter (3.9 hundredths of an inch) and 2.0 millimeters (7.8 hundredths of an inch).

Figure 3:
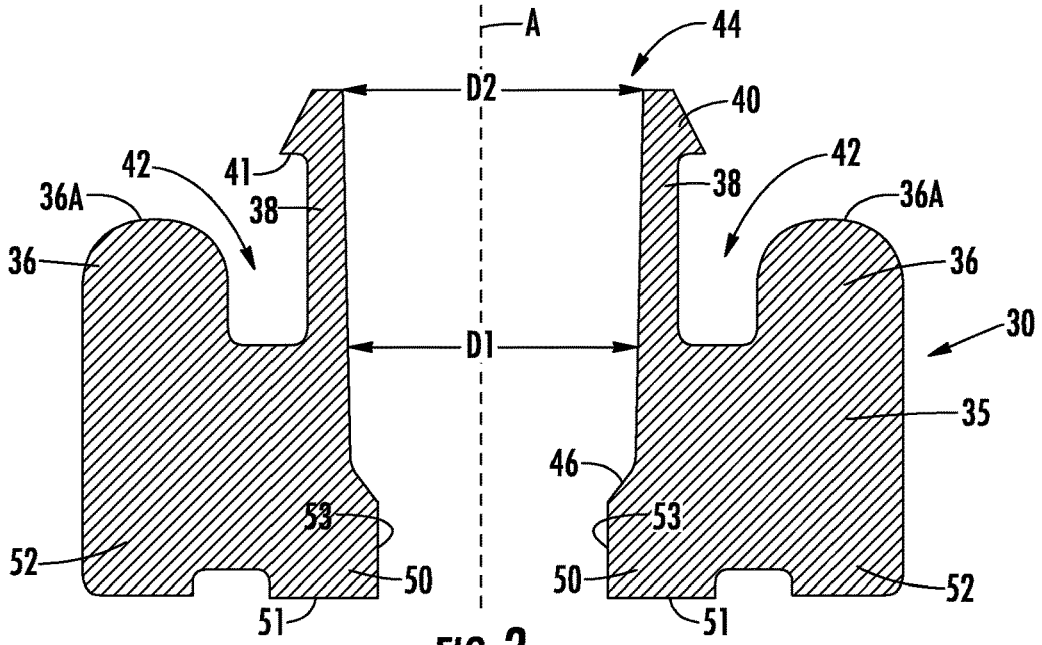
FIG. 3 illustrates a sectional view of a grommet.

As shown in FIG. 3, the bolt opening 44 tapers outward from the ledge 46 to the distal end of the projecting portion 38 such that the mid-portion of the bolt opening 44 includes a diameter D1 and the first axial end of the bolt opening 44 includes a diameter D2 that is larger than the diameter D1. The tapering profile of the bolt opening 44 contributes both to the manufacturability of the grommet 30 as well as the vibration dampening of the grommet 30. In particular, maintaining a radial gap 70 between the sleeve 58 and the grommet 30 further reduces the transfer of vibrations. In the illustrated example, the radial gap extends for more than 50% of an axial length of the sleeve 58. In another example, the radial gap extends between 70% and 85% of the axial length of the sleeve 58.

As shown in FIGS. 2 and 4, the bolt opening 44 also includes a plurality of ribs 48 that extend into the bolt opening 44. The rib 48 extends from the ledge 46 to the distal end of the projecting portion 38. The ribs 48 are spaced from the sleeve 58 such that a clearance gap exists between the ribs 48 and the sleeve 58. In the illustrated example, the grommet 30 includes three ribs 48 spaced 120 degrees from each other. However, the grommet 30 could include less than 3 ribs 48 or more than 3 ribs 48 depending on the specific use. For example, the grommet 30 could include four equally spaced ribs 48.

Additionally, the ribs 48 help to center the sleeve 58 while still maintaining clearance between the sleeve 58 and the projecting portion 38. In the illustrated example, the radially inner base portion 50 of the grommet 30 is the only portion of the grommet 30 that maintains contact with the sleeve 58. However, it is possible that the ribs 48 could be sized to maintain contact with the sleeve 58. In the illustrated example, the radial gap is between 1.0 millimeter (3.9 hundredths of an inch) and 2.0 millimeters (7.8 hundredths of an inch).

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A grommet assembly comprising;

a bolt assembly having a bolt with a head portion and a sleeve at least partially surrounding the bolt; and a grommet including a tapering bolt opening for accepting the bolt assembly, a projecting portion extending from a body portion having an overhang adjacent a distal end, wherein the bolt opening at least partially defines a radial gap between the grommet and the bolt assembly, the head portion of the bolt assembly is spaced from the distal end of the projecting portion by an axial gap, and a proximal end of the sleeve extends from a first pan contact surface on a base of the body portion.

2. The grommet assembly of claim 1, further comprising a plurality of ribs extending radially inward from an inner surface of the bolt opening toward the bolt assembly and a radially inner surface of the ribs are spaced from the bolt assembly.

3. The grommet assembly of claim 1, wherein the grommet includes a support portion extending from the body portion having a support portion base contact surface and the overhang includes an overhang base portion contact surface.

4. The grommet assembly of claim 3, wherein the support portion base contact surface and the overhang base portion contact surface face opposite axial directions and the support portion base contact surface is located radially outward from a radially outermost portion of the overhang.

5. The grommet assembly of claim 1, wherein the head portion includes a cap portion and the cap portion is spaced from the distal end of the projecting portion by the axial gap and the cap portion contacts a distal end of the sleeve.

6. The grommet assembly of claim 1, wherein the radial gap extends more than 50% of an axial length of the sleeve.

7. The grommet assembly of claim 6, wherein the axial length of the sleeve is greater than an axial length of the grommet with a distal end of the sleeve extending longitudinally beyond the projection portion.

8. The grommet assembly of claim 1, further comprising a plurality of ribs extending radially inward from an inner surface of the bolt opening toward the bolt assembly, wherein the head portion includes a cap portion and the cap portion is spaced from the distal end of the projecting portion by the axial gap and the tapering bolt opening tapers radially outward from a mid-portion to a distal end adjacent the projecting portions.

9. The grommet of claim 1, wherein the bolt opening includes a sleeve contact surface engaging a perimeter of the sleeve.

10. The grommet of claim 1, wherein the base of the body portion includes a second pan contact surface spaced radially outward from the first contact surface by a positioning trough extending into the base of the body portion.

11. The grommet of claim 4, wherein the support portion is spaced radially outward from the projection portion and at least partially longitudinally aligned with the projection portion with a trough at least partially separating the projecting portion of the support portion base contact surface.

12. An outdoor HVAC unit comprising:

a housing having a base pan;

a compressor having a base;

a grommet assembly connecting the base pan to the compressor base, wherein the grommet assembly includes:

a bolt assembly having a bolt with a head portion and a sleeve at least partially surrounding the bolt; and a grommet having a tapering bolt opening for accepting the bolt assembly, a projecting portion extending from a body portion having an overhang adjacent a distal end for engaging the compressor base, wherein the bolt opening tapers radially outward from a mid-portion spaced from a ledge to a distal end adjacent the projecting portions, the bolt opening at least partially defines a radial gap between the grommet and the bolt assembly and includes a sleeve contact surface engaging a perimeter of the sleeve, and the head portion of the bolt assembly is spaced from the distal end of the projecting portion by an axial gap.

13. The outdoor HVAC unit of claim 12, wherein the grommet assembly further comprises a plurality of ribs extending radially inward from an inner surface of the bolt opening toward the bolt assembly and a radially inner surface of the ribs are spaced from the bolt assembly.

14. The outdoor HVAC unit of claim 12, wherein the grommet includes a support portion extending from the body portion having a support portion contact surface engaging a first side of the compressor base and the overhang includes an overhang contact surface engaging a second opposite side of the compressor base with the support portion base contact surface located radially outward from a radially outermost portion of the overhang and the projecting portion extends through an opening in the compressor base.

15. The outdoor HVAC unit of claim 12, wherein the head portion includes a cap portion and the cap portion is spaced from the distal end of the projecting portion by the axial gap.

16. The outdoor HVAC unit of claim 12, wherein the radial gap extends more than 50% of an axial length of the sleeve and a proximal end of the sleeve extends from a first pan contact surface on a base of the body portion.

17. The outdoor HVAC unit of claim 16, wherein the axial length of the sleeve is greater than an axial length of the grommet with a distal end of the sleeve extending longitudinally beyond the projection portion.

18. The outdoor HVAC unit of claim 12, wherein the bolt assembly engages the base pan the base of the body portion includes a second pan contact surface spaced radially outward from the first contact surface by a positioning trough extending into the base of the body portion.

19. The outdoor HVAC unit of claim 14, wherein the support portion is spaced radially outward from the projection portion and at least partially longitudinally aligned with the projection portion with a trough at least partially separating the projecting portion of the support portion base contact surface.

* * * * *